US006863266B2

(12) United States Patent
Krlin et al.

(10) Patent No.: US 6,863,266 B2
(45) Date of Patent: Mar. 8, 2005

(54) PUSH BUTTON AIR PRIMER FOR CARBURETOR

(75) Inventors: Pavel Krlin, Ceske Budejovice (CZ); Josef Levy, Vcelna (CZ); Jan Sustr, Hluboka nad Vitaviu (CZ)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/387,829

(22) Filed: Mar. 13, 2003

(65) Prior Publication Data

US 2004/0178519 A1 Sep. 16, 2004

(51) Int. Cl.[7] ..... F02M 1/16

(52) U.S. Cl. ..... 261/35; 123/179.11; 261/DIG. 8; 261/DIG. 67

(58) Field of Search ..... 261/35, DIG. 8, 261/DIG. 67, DIG. 73; 123/179.11

(56) References Cited

U.S. PATENT DOCUMENTS

| | | | | | |
|---|---|---|---|---|---|
| 1,183,183 | A | * | 5/1916 | Funderburk | 261/41.1 |
| 3,177,920 | A | | 4/1965 | Phillips | 158/36.4 |
| 3,307,836 | A | | 3/1967 | Arndt et al. | 261/34 |
| 3,948,589 | A | | 4/1976 | DeBois | 417/487 |
| 3,978,839 | A | | 9/1976 | DeBois et al. | 123/187.5 R |
| 4,228,110 | A | | 10/1980 | Magnet | 261/37 |
| 4,309,968 | A | | 1/1982 | DuBois | 123/187.5 R |
| 4,411,844 | A | | 10/1983 | Morris et al. | 261/34 R |
| 4,589,386 | A | | 5/1986 | Everts | 123/187.5 R |
| 4,660,516 | A | | 4/1987 | Baltz et al. | 123/179.9 |
| 4,747,760 | A | | 5/1988 | Eberl et al. | 417/443 |
| 4,926,808 | A | | 5/1990 | Kandler | 123/187.5 R |
| 5,070,829 | A | * | 12/1991 | Guntly et al. | 123/179.9 |
| 5,071,325 | A | | 12/1991 | Tupper et al. | 417/496 |
| 5,664,532 | A | | 9/1997 | August | 123/179.11 |
| 5,711,901 | A | * | 1/1998 | Berg et al. | 261/35 |
| 5,740,781 | A | * | 4/1998 | Scott et al. | 123/437 |
| 6,152,431 | A | | 11/2000 | Stenz et al. | 261/34.1 |
| 6,374,782 | B2 | | 4/2002 | Ishikawa et al. | 123/73 AF |
| 6,561,495 | B2 | * | 5/2003 | Woody | 261/37 |
| 6,595,500 | B2 | * | 7/2003 | Osburg et al. | 261/34.2 |

FOREIGN PATENT DOCUMENTS

| | | | | |
|---|---|---|---|---|
| JP | 1-190954 | * | 8/1989 | 261/DIG. 8 |
| JP | 2-204668 | * | 8/1990 | 261/DIG. 8 |

* cited by examiner

*Primary Examiner*—Richard L. Chiesa
(74) *Attorney, Agent, or Firm*—Baker & Daniels

(57) ABSTRACT

A push button air primer including a priming piston slidably housed in a primer housing and a sealing piston slidably housed in the priming piston. To prime the carburetor, the operator depresses the priming piston causing both priming piston and sealing piston to slide within the primer housing until the sealing piston bears against the carburetor body to seal an opening to an internal vent passage. Further movement of the priming piston forces air from the housing into a fuel bowl, thereby pressurizing the fuel bowl and causing fuel to move from the fuel bowl into the throat of the carburetor.

20 Claims, 4 Drawing Sheets

PUSH BUTTON AIR PRIMER FOR CARBURETOR

BACKGROUND OF THE INVENTION

1. Field of the Invention

The present invention relates to carburetors and, particularly, to carburetors for small internal combustion engines of the type used with lawn mowers, lawn tractors, and small implements, as well as sport vehicles.

2. Description of the Related Art

Small internal combustion engines typically include a carburetor, which provides an air-fuel combustion mixture to the engine. One type of carburetor commonly used in small engines includes a fuel bowl for storing fuel and a throat with a venturi region through which air is drawn and into which fuel is drawn for mixing with the intake air. When the pressure in the fuel bowl is greater than the pressure in the venturi region, as is the case when the engine is running, fuel is drawn from the fuel bowl and conveyed through a conduit to the venturi region where it is mixed with air and supplied to the engine.

When the engine is at rest, the pressure in the fuel bowl is not greater than the pressure in the venturi region, and therefore, fuel is not drawn from the fuel bowl into the venturi region. In order to start the engine, the carburetor must be primed so that an adequate air-fuel mixture is supplied to the engine. Typically, to prime the engine, the fuel bowl is pressurized to force an amount of priming fuel from the fuel bowl into the venturi region to provide an enriched air/fuel mixture for engine starting.

One primer system includes a resilient primer bulb or bellows that, when manually depressed, increases the pressure in the fuel bowl, causing an amount of priming fuel to flow from the fuel bowl through a nozzle into the carburetor throat. In some of these systems, the primer bulb also serves as a check valve to seal off an internal vent passage within the carburetor, such that air within a priming chamber is directed into the fuel bowl to pressurize the fuel bowl.

The foregoing priming systems require an operator to manually depress a priming bulb which may present potential problems. For instance, if the operator does not depress the bulb completely, the resulting pressure in the fuel bowl may be inadequate to invention is relatively inexpensive to manufacture. Also, the push button primer of the present invention is simple to operate, and the rigidity of the parts, as well as the guided, sliding relationship therebetween restricts the primer movement to a straight line, thereby reducing the potential for operator errors.

In one form thereof, the present invention provides a carburetor, including a carburetor body having a throat; a fuel bowl storing a quantity of fuel therein, the fuel bowl in communication with the throat; an internal vent passage in communication with the throat; and a primer assembly, including a housing on the carburetor body at least partially defining a priming chamber containing air therein, the priming chamber in communication with the fuel bowl and with the internal vent passage; and a piston assembly supported by the housing for sliding movement to vary the volume of the priming chamber, the piston assembly including a portion moveable into blocking engagement with the internal vent passage when the piston assembly is actuated to allow displacement of air from the priming chamber into the fuel bowl.

In another form thereof, the present invention provides a carburetor, including a carburetor body having a throat; a fuel bowl in communication with the throat and storing a quantity of fuel therein; a housing portion having an opening, and defining at least a portion of a priming chamber having air therein, the priming chamber in communication with the fuel bowl; an internal vent passage communicating the priming chamber with the throat; and a piston assembly having a sealing portion, the piston assembly supported within the opening for sliding movement between a first position in which the priming chamber is in communication with the internal vent passage and with the fuel bowl, and a second position in which the sealing portion is in blocking engagement the internal vent passage to allow displacement of air from the priming chamber into the fuel bowl.

In a further form thereof, the present invention provides a method of priming a carburetor for starting an internal combustion engine, including the steps of sealing a vent passage within the carburetor from a fuel bowl of the carburetor by initial depression of a piston assembly within a priming chamber such that a sealing portion of the piston assembly blocks the internal vent passage; and pressurizing the fuel bowl by further depression of the piston assembly to force air within the priming chamber into the fuel bowl to thereby convey fuel from the pressurized fuel bowl to a carburetor throat. cause a sufficient amount of fuel to flow into the throat. In addition, the bulb is most effective as a check valve when it is depressed directly inwardly toward the carburetor along a straight line. If the operator depresses the bulb at an angle, the bulb may not effectively seal off the internal vent passage, allowing air to leak into the internal vent passage such that the fuel is not pressurized sufficiently to provide priming fuel to the carburetor throat in an amount effective for engine starting.

A number of other primer systems use a primer bulb to introduce liquid fuel directly into the carburetor throat. In these systems, fuel is drawn into the primer bulb when the bulb is depressed and released. When the primer bulb is depressed again, the fuel contained in the primer bulb is forced from the bulb to the throat. This system poses similar disadvantages. If the primer bulb is not depressed completely, the fuel injected from the bulb to the throat may be insufficient to start the engine.

Other primer systems have been developed which include complex electronic devices that sense engine temperature and fuel line pressure. When a certain threshold is sensed, the electronic primer advises the user to terminate manual priming. However, the inclusion of electronic devices in a priming system significantly increases the manufacturing costs of the priming system.

It is desired to provide a primer system for small engine carburetors that is an improvement over the foregoing.

SUMMARY OF THE INVENTION

The present invention provides a push button air primer for a small internal combustion engine that is simple, durable inexpensive and easy to operate. The primer includes a priming piston slidably housed in a primer housing and a sealing piston slidably housed in the priming piston. To prime the carburetor, the operator depresses the priming piston causing both the priming piston and the sealing piston to slide within the primer housing until the sealing piston reaches the surface of the carburetor body. At this point, sealing piston bears against the carburetor body to seal an opening to the internal vent passage. Further sliding of the priming piston within the chamber forces air from the housing into a fuel bowl, thereby pressurizing the fuel bowl and forcing a quantity of priming fuel from the fuel bowl into the throat of the carburetor.

The push button air primer of the present invention is a simple mechanical structure, therefore the cost of assembly is relatively low. In addition, the parts thereof are also relatively low in cost. For these reasons, the push button air primer of the present

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 1:
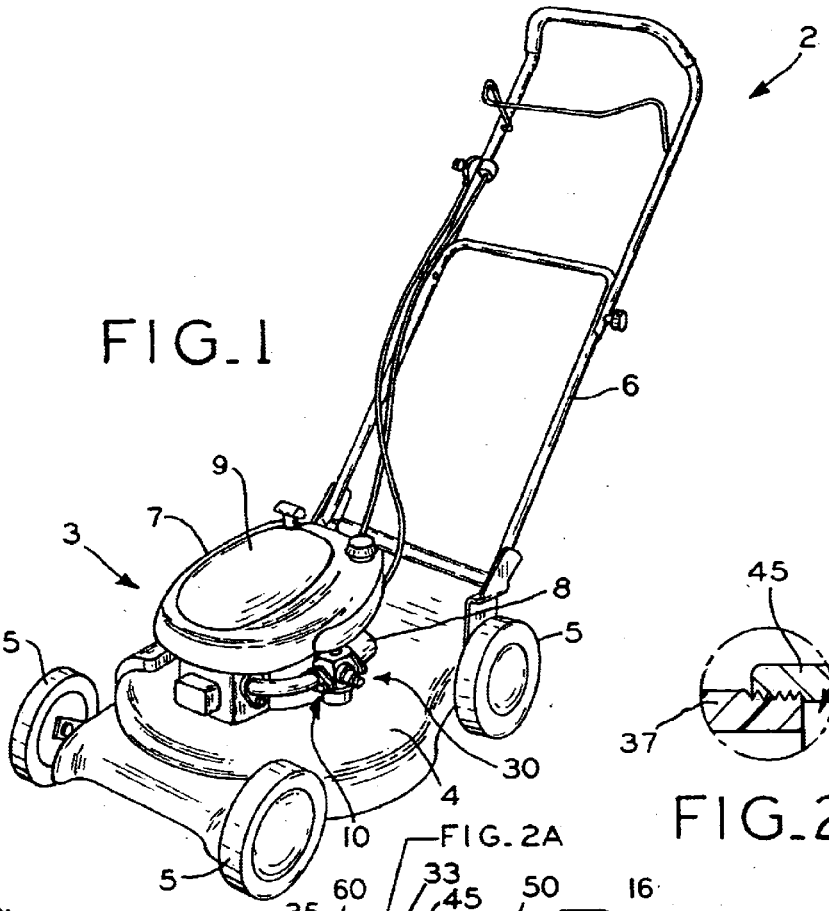
FIG. 1 is a perspective view of a lawn mower including a carburetor with a push button air primer in accordance with the present invention.

Referring to FIG. 1, an exemplary implement is shown, for example, as lawnmower 2, which includes engine 3 mounted to mower deck 4. Lawnmower 2 additionally includes wheels 5 and handle 6 mounted to mower deck 4. Housing 7 of engine 3 includes crankcase 8 and blower housing or shroud 9. The working components of engine 3 (not shown), such as a crankshaft, connecting rod and piston assembly, are housed within crankcase 8. Carburetor 10 is connected to engine housing 7, and includes push button primer assembly 30, described below, which is easily accessible by an operator. Although primer assembly 30 is shown in FIG. 1 associated with carburetor 10 of engine 3 of lawnmower 2, primer assembly 30 may be used with carburetors for a variety of small internal combustion engines used with a variety of implements, such as snow throwers, tillers, and the like.

Figure 2A:
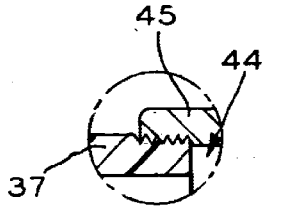
FIG. 2A is an enlarged fragmentary view of the encircled portion in FIG. 2.
Figure 2:
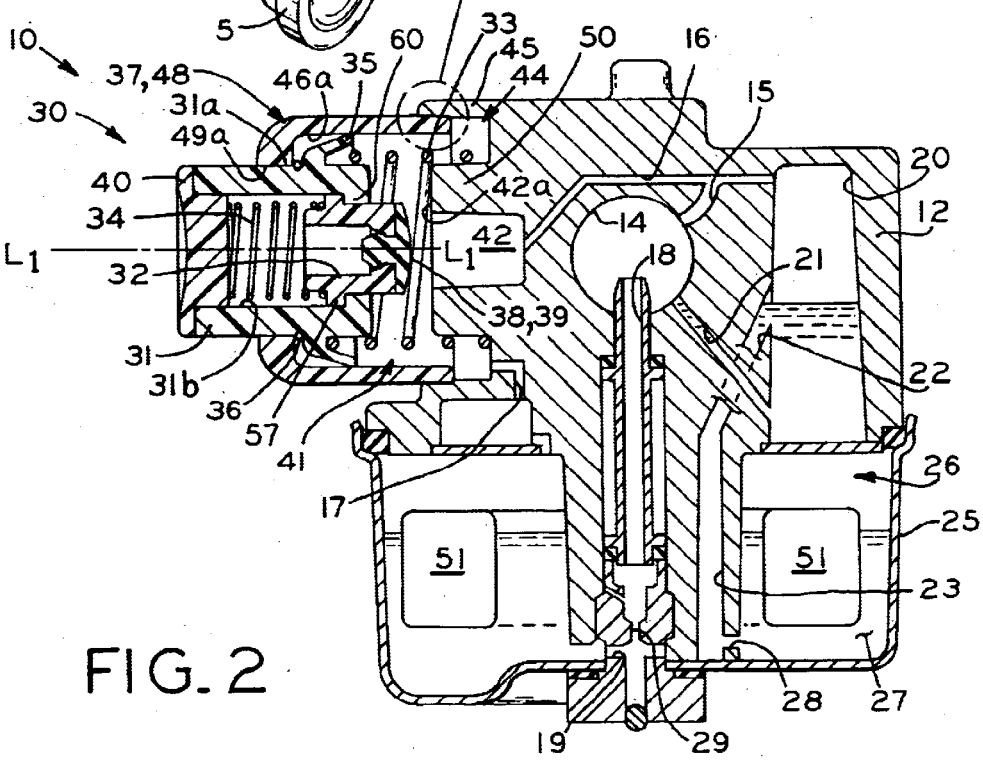
FIG. 2 is a sectional view of the carburetor of FIG. 1, including a push button air primer assembly in accordance with a first embodiment, disposed in a first position.

FIG. 2 illustrates carburetor 10 for providing a combustible fuel/air mixture to engine 3. Carburetor 10 includes may features similar to the carburetors disclosed in U.S. Pat. Nos. 4,926,808 and 6,152,431, each assigned to the assignee of the present invention, which patents are incorporated herein by reference, and carburetor 10 further includes primer assembly 30, described below.

Carburetor 10 generally includes a carburetor body 12 having an air mixture-passage or throat 14, which is in communication with the combustion chamber (not shown) of engine 3. Carburetor body 12 is connected to fuel bowl 25, which stores an amount of fuel 27 and contains air space 26 above fuel 27. Air space 26 of fuel bowl 25 is at atmospheric pressure when engine 3 is not running as a result of the internal venting of carburetor 10 through priming passage 17, which communicates to the atmosphere through internal vent passage 16 connected to throat 14. Internal vent passage 16 connects cavity 42 within boss 50 of carburetor body 12 with extended prime fuel chamber 20, and further includes throat vent passage 15 opening into throat 14.

During running of engine 3, the vacuum within the venturi region of throat 14 draws fuel 27 from fuel bowl 25 through fuel orifice 19 and conduit orifice 29, and upwardly through conduit 18 into throat 14. Float 51 floats on fuel 27 within fuel bowl 25, and is operatively connected to a valve (not shown) for metering the supply of fuel into fuel bowl 25 from a fuel tank (not shown) as fuel 27 is consumed by engine 3.

Figure 3:
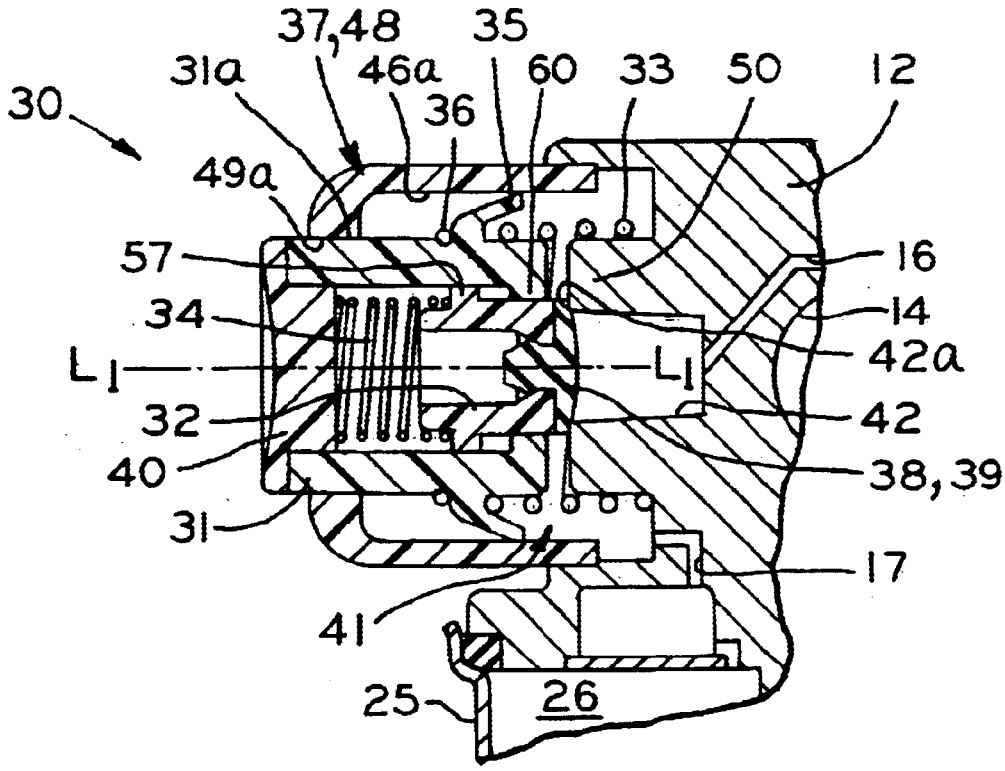
FIG. 3 is a sectional view of the carburetor of FIG. 1, showing the push button air primer assembly disposed in a second position.
Figure 4:
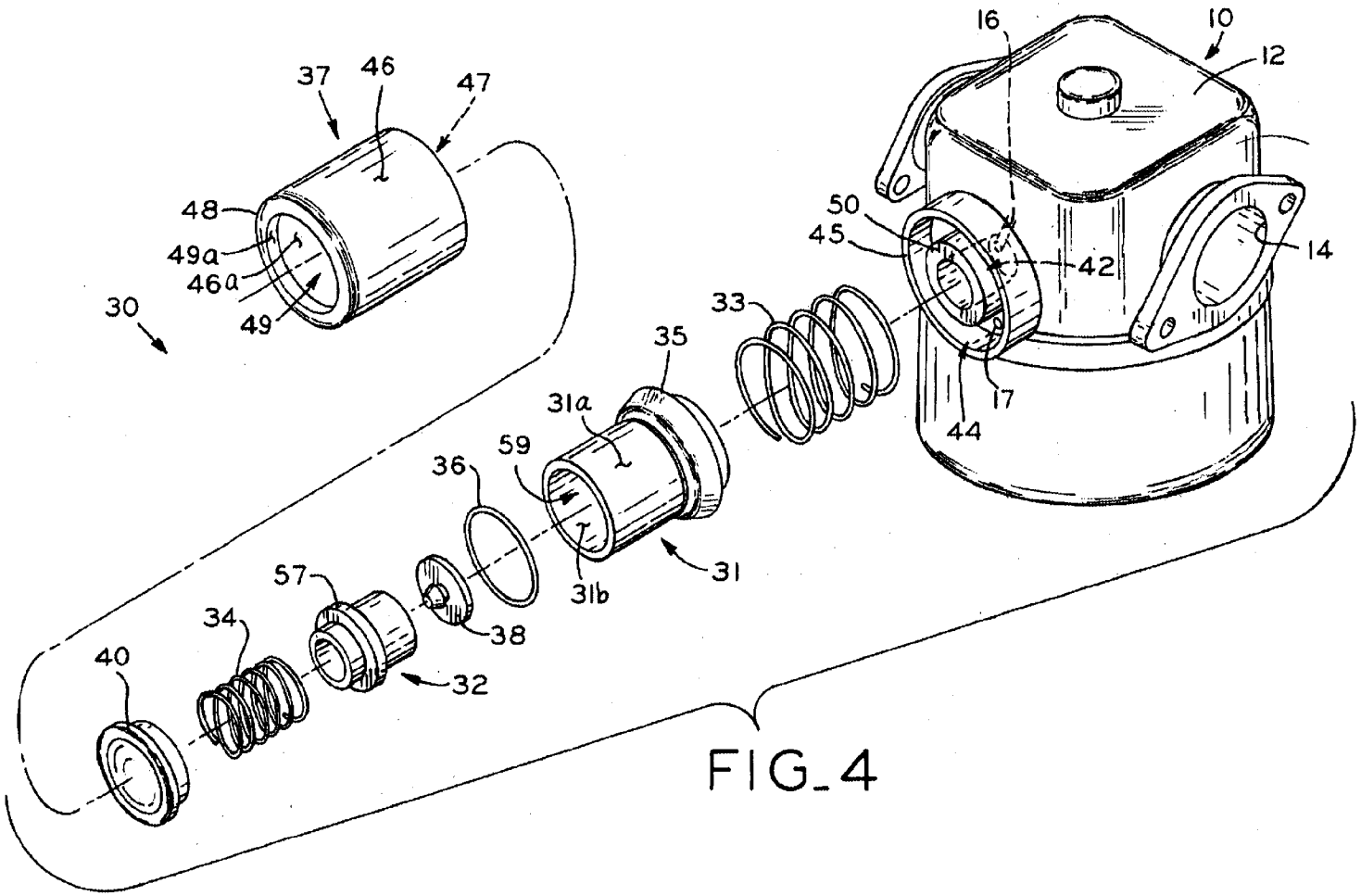
FIG. 4 is an exploded view, showing the components of the push button air primer assembly of FIGS. 2 and 3.

In order to prime engine 3, carburetor 10 is provided with a push button primer assembly 30. Referring now to FIGS. 2-4, primer assembly 30 generally includes primer housing 37 defining a priming chamber 41 between primer housing 37 and carburetor body 12, priming piston 31 slidably housed within primer housing 37, sealing piston 32 slidably housed within priming piston 31, first return spring 33, and second return spring 34. Primer chamber 41 is in communication with internal vent passage 16 via cavity 42, and is also in communication with fuel bowl 25 via priming passage 17.

Primer housing 37 is generally cup-shaped, having a substantially cylindrical wall 46, an open end 47 and an opposite end 48 having opening 49 with inner annular surface 49*a*. Primer housing may be formed from metal, or a semi-rigid or rigid plastic material. Open end 47 of primer housing 37 is rigidly mounted, via a press-fit engagement, for example, within annular recess 44 which is formed by annular wall 45 of carburetor body 12. Alternatively, as shown in FIG. 2A, primer housing 37 may be rigidly mounted within annular recess 44 in a screw-threaded engagement. End 48 of primer housing 37 defines opening 49 through which priming piston 31 is slidably received. Priming piston 31 is substantially cylindrical, and includes exterior surface 31*a* and interior surface 31*b*. Priming piston 31 may be made from a semi-rigid plastic material, for example, such as Celcon® M90, available from Ticona Inc., 90 Morris Ave., Summit, N.J. 07901. (Celcon® is a registered trademark of Celanese Corp., 522 5th Ave., New York, N.Y. 10036).

Priming piston 31 is closely received within opening 49 of primer housing 37, such that exterior surface 31*a* of priming piston 31 engages interior surface 49*a* of opening 49 of primer housing 37, as shown in FIGS. 2 and 3. In this manner, primer housing 37 supports primer piston 31 for sliding movement which is confined along line $L_1$—$L_1$. Although line $L_1$—$L_1$ is shown in FIGS. 2 and 3 generally perpendicular to throat 14 of carburetor 10, line $L_1$-$L_1$ may be oriented along any direction.

Priming piston 31 also includes rim 60 (FIG. 2) at one end thereof, and defines a cylindrical cavity 59 extending the length of priming piston 31. Priming piston 31 further includes stopper 40 fit into the end of priming piston opposite rim 60 for closing cavity 59. Priming piston 31 is provided with an annular, external lip seal 35 therearound, which is radially compressed when priming piston 31 is inserted into primer housing 37, and which bears against inner surface 46*a* of cylindrical wall 46 of primer housing 37, thereby providing a sliding, sealing engagement between lip seal 35 of priming piston 31 and wall 46 of primer housing 37.

Sealing piston 32 is slidably mounted within cylindrical cavity 59 of priming piston 31, and includes a stop flange 57 protruding radially from the outer surface of sealing piston 32. Stop flange 57 engages inner surface 31*b* of priming piston 31, such that sealing piston 32 is supported within priming piston 31 for sliding movement which is confined along line $L_1$-$L_1$. Stop flange 57 limits the sliding movement of sealing piston 32 within priming piston 31 by engaging rim 60 of priming piston 31, as shown in FIG. 2. Sealing piston 32 also includes a plug 38 having a sealing surface 39 sized to sealingly engage opening 42*a* of cavity 42. Sealing piston 31 may be made from a semi-rigid plastic material, for example, such as Celcon® M90, available from Ticona Inc., 90 Morris Ave., Summit, N.J. 07901. (Celcon®) is a registered trademark of Celanese Corp., 522 5th Ave., New York, N.Y. 10036). Plug 38 may be made from rubber, or any suitable compressible elastomeric material.

As shown in FIGS. 2 and 3, first return spring 33 is mounted under compression within primer housing 37, with a first end thereof seated against carburetor body 12, and an opposite, second end thereof seated within external lip seal 35 of priming piston 31. In this manner, the bias force of spring 33 aids in maintaining the sealing engagement between lip seal 35 of priming piston 31 and the inner surface 46*a* of cylindrical wall 46 of primer housing 37. Second return spring 34 is mounted under compression within cylindrical cavity 59 of priming piston 31, with a first end thereof seated against stop flange 57 of sealing piston 32, and a second end thereof seated against stopper 40 of priming piston 31. As shown in FIG. 2, first return spring 33 biases priming piston 31 away from carburetor body 12 along line $L_1$—$L_1$, while second return spring 34 biases sealing piston 32 away from stopper 40 and toward carburetor body 12 along $L_1$—$L_1$.

To prime the engine for starting, the operator pushes against stopper 40 thereby compressing first return spring 33 and sliding priming piston 31 and sealing piston 32 together along line $L_1$—$L_1$ within priming chamber 41 toward carburetor body 12. As shown in FIG. 2, when sealing piston 32 reaches carburetor body 12, sealing surface 39 of plug 38 seats against boss 50 of carburetor body 12, thereby sealing off opening 42*a* to internal vent passage 16. Sealing piston 32 is held in this position by second return spring 34, which biases sealing piston 32 toward boss 50 of carburetor body 12 to maintain the foregoing seal. The close sliding engagement between priming piston 31 and primer housing 37, as well as between priming piston 31 and sealing piston 32, prevents the angular displacement of priming piston 31 and sealing piston 32 away from line $L_1$—$L_1$, thus ensuring that sealing surface 39 of plug 38 is aligned with, and sealingly engages boss 50 of carburetor body 12 to seal internal vent passage 16 from priming chamber 41. In this manner, priming assembly 30 reduces the possibility of operator error.

Further movement of priming piston 31 within priming chamber 41 forces air contained within priming chamber 41 through bowl vent passage 17 to fuel bowl 25 to pressurize fuel bowl 25. As priming piston 31 slides within priming chamber 41, external lip seal 35 of priming piston 31 sealingly engages cylindrical wall 46 of primer housing 37 to seal priming chamber 41 and prevent air from leaking from priming chamber 41 into the atmosphere.

The increase in pressure in fuel bowl 25 causes a portion of fuel 27 to flow from fuel bowl 25 to throat 14 via conduit 18. The fuel forced into throat 14 via conduit 18 is mixed with air to form a rich air/fuel mixture, which is supplied to the combustion chamber (not shown) of the engine to aid in engine starting. When the operator releases priming piston 31, first return spring 33 biases priming piston 31 outward from carburetor body 12, thus releasing sealing piston 32 from its sealing position and opening internal vent passage 16 to allow air into priming chamber 41 through internal vent passage 16. When priming piston 31 and sealing piston 32 return to the position shown in FIG. 1, O-ring 36, positioned around priming piston 31 adjacent lip seal 35, is captured and compressed between lip seal 35 and end 48 of primer housing 37 to prevent dust from entering priming chamber 41.

As illustrated in FIG. 2, carburetor 10 can also include an extended prime fuel chamber 20, for providing a rich air-fuel mixture to last through engine warm up. Extended prime fuel chamber 20 is similar to the extended prime fuel chamber disclosed in U.S. Pat. No. 6,152,431. The lower portion of extended prime fuel chamber 20 communicates with throat 14 though extended prime fuel passage 21 and the upper portion of extended prime fuel chamber 20 communicates with internal vent passage 16. Extended prime fuel chamber also communicates with the lower portion of fuel bowl 25 through a pair of interconnected fuel fill passages 22, 23 and metering orifice 28.

Priming a carburetor having an extended prime fuel chamber is essentially as described above except that the increase in pressure in fuel bowl 25 causes fuel to flow not only to throat 14, but also to extended prime fuel chamber 20 via fuel fill passages 22, 23. Once the engine starts, fuel is drawn from extended prime fuel chamber 20 to throat 14 via prime fuel passage 21 to provide an enriched air/fuel mixture through a warm-up running period of engine 3, until extended prime fuel chamber 20 is empty.

Figure 5:
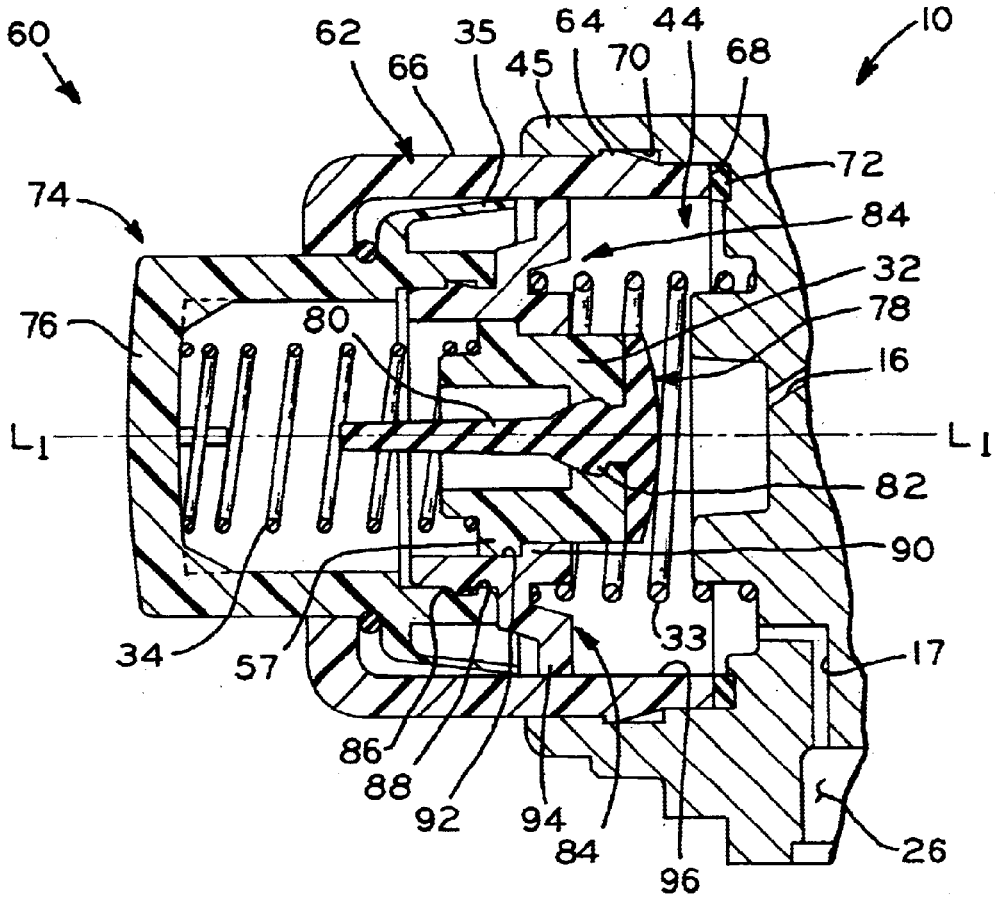
FIG. 5 is a fragmentary view of a portion of the carburetor of FIG. 1, showing an air primer assembly in accordance with a second embodiment.

Referring to FIG. 5, primer assembly 30' is shown, according to a second embodiment. The components and operation of primer assembly 30' are identical to the components and operation of primer assembly 30, except as described below, and like reference numerals have been used to designate identical components therebetween. Components of primer assembly 30' which are modified from those of primer assembly 30 are designated with primed (') reference numerals.

Primer assembly 30' includes primer housing 37' having annular ridge or tooth 70 projecting from outer surface 46' thereof adjacent its open end 47'. Ridge 70 is received and retained in a locking manner within annular groove 72' around the interior of wall 45 of carburetor 10 when primer housing 37' is pressed into annular recess 44 of carburetor 10 to thereby fixedly attach primer housing 37' to carburetor 10. Also, a compressible O-ring 74 is provided between primer housing 37' and carburetor 10 to provide a seal therebetween.

Priming piston 31' is formed with an integral closed end portion 76 such that the need for stopper 40 is obviated. Also, plug 38' is formed with an elongated tail portion 78 which may be grasped by a suitable tool for pulling plug 38' into the open end of sealing piston 32, until ridge 80 of plug 38' locks within recess 82 of sealing piston 32 to mount plug 38' to sealing piston 32.

Primer assembly 30' additionally includes guide plate 84, an annular component disposed between priming piston 31 and sealing piston 32. Specifically, guide plate 84 abuts open end 47' of priming piston 31' and includes shoulder 86 abutting stop flange 57 of sealing piston 32. Stop flange 57 of sealing piston 32 is slidable with respect to inner surface 88 of guide plate 84. Guide plate 84 also includes outer rim 90, which is positioned closely adjacent inner surface 46*a*' of primer housing 37'. In this manner, if the orientation of priming piston 31' should begin to deviate from longitudinal axis $L_1$-$L_1$ of primer assembly 30' during actuation thereof, outer rim 90 of guide plate 84 will slidably contact inner surface 46*a*' of primer housing 37' to maintain the orientation of priming piston 31'. In this manner, guide plate 84 aids in maintaining the travel of priming piston 31' along longitudinal axis $L_1$—$L_1$ of primer assembly 30'.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A carburetor, comprising:

a carburetor body having a throat;

a fuel bowl storing a quantity of fuel therein, said fuel bowl in communication with said throat;

an internal vent passage in communication with said throat; and a primer assembly, comprising:

a housing on said carburetor body at least partially defining a priming chamber containing air therein, said priming chamber in communication with said fuel bowl and with said internal vent passage; and a piston assembly supported by said housing for sliding movement to vary the volume of said priming chamber, said piston assembly including a portion moveable into blocking engagement with said internal vent passage when said piston assembly is actuated to allow displacement of air from said priming chamber into said fuel bowl.

2. The carburetor of claim 1, wherein said housing includes an opening, said piston assembly guidingly received within said opening.

3. The carburetor of claim 1, wherein said piston assembly comprises:

a first piston supported by said housing for sliding movement relative to said housing; and a second piston supported by said first piston for sliding movement relative to said first piston.

4. The carburetor of claim 3, wherein said second piston includes said sealing surface.

5. The carburetor of claim 3, wherein said first and second pistons are supported for confined sliding movement along a common axis.

6. The carburetor of claim 3, wherein said first piston includes an annular, external lip seal slidably engaging an inner surface of said housing to seal said first piston with respect to said housing.

7. The carburetor of claim 3, further comprising a first return spring disposed under compression between said carburetor body and said first piston to bias said first piston outwardly from said carburetor body.

8. The carburetor of claim 4, further comprising a second return spring disposed under compression between said first and second pistons to bias said sealing surface of said second piston into blocking engagement with said internal vent passage when said piston is actuated.

9. The carburetor of claim 1, wherein said primer housing is mounted to said carburetor body via one of a press-fit engagement and a screw-threaded engagement.

10. A carburetor, comprising:

a carburetor body having a throat;

a fuel bowl in communication with said throat and storing a quantity of fuel therein;

a housing portion having an opening, and defining at least a portion of a priming chamber having air therein, said priming chamber in communication with said fuel bowl;

an internal vent passage communicating said priming chamber with said throat; and a piston assembly having a sealing portion, said piston assembly supported within said opening for sliding movement between a first position in which said priming chamber is in communication with said internal vent passage and with said fuel bowl, and a second position in which said sealing portion is in blocking engagement with said internal vent passage to allow displacement of air from said priming chamber into said fuel bowl.

11. The carburetor of claim 10, wherein said opening includes an inner surface, and said piston assembly includes an external surface slidably engaging said inner surface.

12. The carburetor of claim 10, wherein said housing portion comprises a separate component from said carburetor body, said housing portion mounted to said carburetor body via one of a press-fit engagement and a screw-threaded engagement.

13. The carburetor of claim 10, further comprising a priming passage communicating said priming chamber with said fuel bowl.

14. The carburetor of claim 10, wherein said piston assembly comprises:

a first piston supported by said housing portion for sliding movement relative to said priming chamber opening; and a second piston supported by said first piston for sliding movement relative to said first piston.

15. The carburetor of claim 14, wherein said second piston includes said sealing portion.

16. The carburetor of claim 14, wherein said first and second pistons are supported for confined sliding movement along a common axis.

17. The carburetor of claim 14, further comprising a first return spring disposed under compression between said carburetor body and said first piston to bias said first piston outwardly from said carburetor body.

18. The carburetor of claim 15, further comprising a second return spring disposed under compression between said first and second pistons to bias said sealing portion of said second piston into blocking engagement with said internal vent passage when said piston is in said second position.

19. The carburetor of claim 14, wherein said first piston includes an annular, external lip seal in sliding engagement with an inner surface of said priming chamber to seal said piston assembly with respect to said priming chamber.

20. A method of priming a carburetor for starting an internal combustion engine, comprising the steps of:

sealing a vent passage within the carburetor from a fuel bowl of the carburetor by initial depression of a piston assembly within a priming chamber such that a sealing portion of the piston assembly blocks the internal vent passage; and pressurizing the fuel bowl by further depression of the piston assembly to force air within the priming chamber into the fuel bowl to thereby convey fuel from the pressurized fuel bowl to a carburetor throat.

* * * * *